US007093699B2

(12) United States Patent
Yu

(10) Patent No.: US 7,093,699 B2
(45) Date of Patent: Aug. 22, 2006

(54) LUGGAGE COVER

(75) Inventor: Chris Yu, Carson, CA (US)

(73) Assignee: Luggage America, Inc., Carson, CA (US)

( * ) Notice: Subject to any disclaimer, the term of this patent is extended or adjusted under 35 U.S.C. 154(b) by 0 days.

(21) Appl. No.: 10/971,854

(22) Filed: Oct. 22, 2004

(65) Prior Publication Data

US 2006/0086444 A1 Apr. 27, 2006

(51) Int. Cl.
*A45C 13/30* (2006.01)
*B65D 65/02* (2006.01)

(52) U.S. Cl. ..... 190/26; 150/154

(58) Field of Classification Search ..... 150/105, 150/154; 190/26, 100, 102; 383/111
See application file for complete search history.

(56) References Cited

U.S. PATENT DOCUMENTS

| | | | | | |
|---|---|---|---|---|---|
| 1,526,839 | A * | 2/1925 | Dempsey | 190/26 |
| 1,560,783 | A * | 11/1925 | Halpin | 190/26 |
| 2,432,365 | A * | 12/1947 | Allen | 190/115 |
| 2,436,237 | A * | 2/1948 | Brandt | 150/154 |
| 2,520,250 | A * | 8/1950 | Meyers | 190/26 |
| 2,617,504 | A * | 11/1952 | Meyers | 190/26 |
| 2,647,595 | A * | 8/1953 | Meyers | 190/26 |
| 2,724,467 | A * | 11/1955 | Jaffe | 190/26 |
| 5,154,332 | A * | 10/1992 | Williams et al. | 224/153 |
| 5,255,765 | A * | 10/1993 | Schrecongost | 190/26 |
| 6,315,178 | B1 * | 11/2001 | Nobata | 224/153 |
| 2003/0116392 | A1 * | 6/2003 | Oh | 190/102 |
| 2005/0051247 | A1 * | 3/2005 | Johnson | 150/154 |

FOREIGN PATENT DOCUMENTS

| | | | |
|---|---|---|---|
| GB | 2167656 | A * | 6/1986 |
| GB | 2253781 | A * | 9/1992 |
| JP | 472145 | A * | 3/1992 |

* cited by examiner

*Primary Examiner*—Sue A. Weaver
(74) *Attorney, Agent, or Firm*—Lee, Hong, Degerman, Kang & Schmadeka

(57) ABSTRACT

A luggage cover for covering a luggage container, comprising a plurality of panels comprising a front panel, a rear panel, a top panel, a bottom panel, a first side panel, and a second side panel, the panels capable of being shaped into a protective shell for covering the luggage container, and a first fastening apparatus for detachably fastening the plurality of panels together to maintain the shape of the protective shell, wherein one of the plurality of panels is an expandable panel.

16 Claims, 5 Drawing Sheets

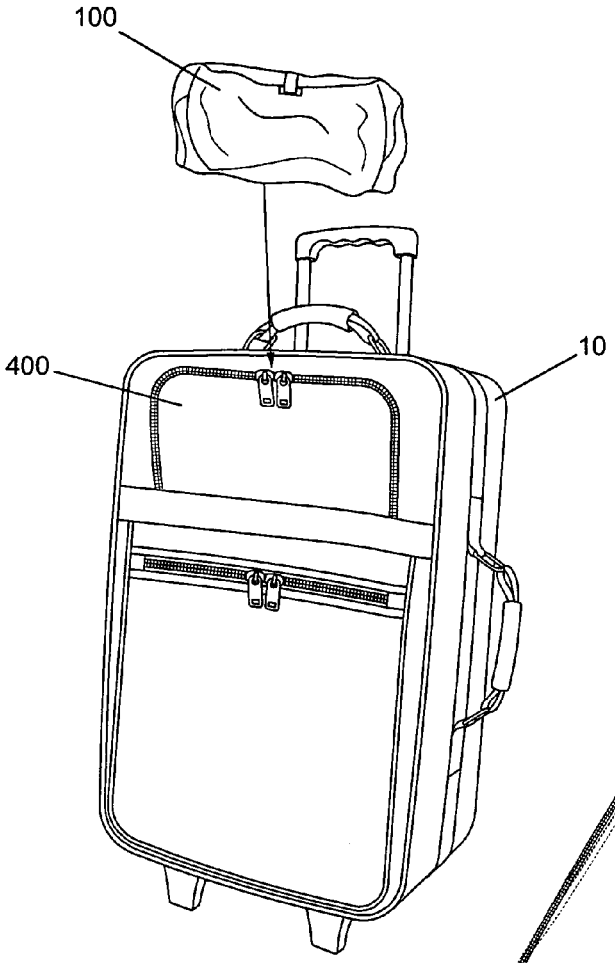
FIG. 6
FIG. 7
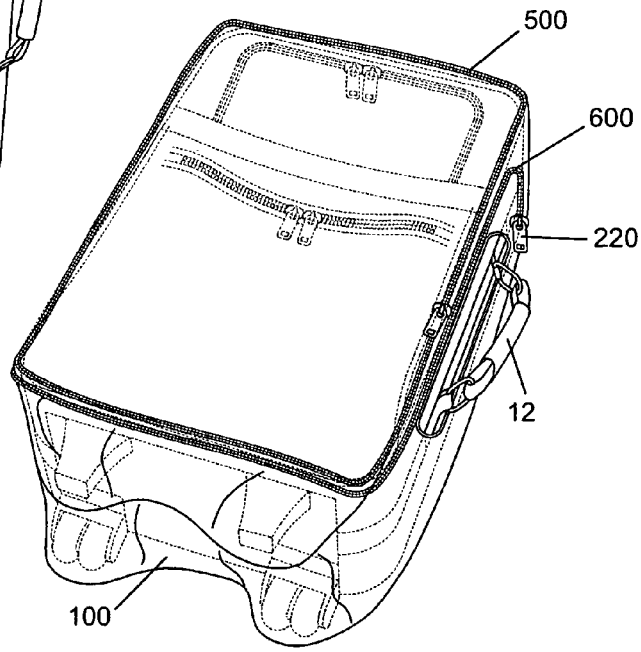

LUGGAGE COVER

BACKGROUND OF THE INVENTION

1. Field of the Invention

The present invention relates generally to a protective cover, and more particularly, to an expandable luggage cover for protecting an expandable luggage container.

2. Description of the Related Art

There has always been a need to protect one's luggage from exposure to natural elements, general wear-and-tear, and overall deterioration, just as there has always been a need for luggage to effectively protect the contents placed within. The need to protect luggage from such conditions has increased more so due to the rising cost of quality-crafted luggage and subsequent maintenance. These costs are compounded by the fact that some luggage items are manufactured with perishable materials such as leather and are subject to a higher rate of deterioration.

Prior art has shown the use of protective covers for various items including luggage to increase the useful life of the product. However, such covers for luggage are often bulky and awkward and, due to their relatively large surface areas, the covers often occupy large amounts of valuable space within the main compartments of the luggage containers if transported. Subsequently the user is required to open the main compartment in transit, search for and extract the cover, and finally deploy it. This time consuming process allows for further exposure of the luggage container to the elements.

In addition, these covers are not likely to be tailored to the dimensions of the luggage item. Accordingly, a cover may prove to be too small (in the case of a large suitcase) or too large (in the case of smaller "carry-on" luggage) for the luggage container it is attempting to protect. Should a cover be too small for the intended luggage item, a portion of the luggage may remain exposed. The resulting disparity in deterioration between the exposed and covered areas of the luggage item may detract from the aesthetic and physical qualities of the luggage item. Also, during transport, the leading edge of the undersized cover may allow the cover to become caught on protruding objects. This situation also arises for protective covers that may be too large for its intended luggage container, where loose portions of the cover may get snagged or get caught in moving parts such as a luggage conveyor system at an airport.

Further problems arise when considering luggage containers capable of adjusting their volume capacity. Typically, these containers comprise an expandable main compartment kept in an unexpanded state by a fastening apparatus such as zipper mechanism. When a user does not require much luggage room, the user may utilize the luggage container in the unexpanded state. However, if the user wishes to carry additional luggage in the luggage container, the user may unfasten the fastening apparatus to expand the expandable compartment. In the expanded state, more luggage may be accommodated in the luggage container because of the increased volume. Accordingly, prior art protective covers do not give expandable luggage containers adequate protection. While a cover may sufficiently protect the container in the unxepanded state, the cover cannot fittingly accommodate the luggage container when utilized in the expanded state.

Prior art has attempted to address the concern of better fitting covers for luggage containers. U.S. Pat. No. 6,279,796 issued to Trevino on Aug. 28, 2001 illustrates the use of a drawstring in covers incorporated into backpacks. This system may work well with backpacks and smaller luggage containers which can be handled easily without requiring the container to be set down and allow for a facet of the container to be exposed. However, bulkier luggage containers such as suitcases require covers with more robust means of enclosing the container than drawstrings. During transport and handling, bulkier luggage containers would create undue pressure against the contraction provided by the drawstring, thus expanding the aperture and allowing a portion of the luggage to be exposed. Should the perimeter controlled by the drawstrings be great enough, the luggage container could slip out from within the cover.

Although various attempts have been made to solve the problem of effectively covering a luggage container, as cost and extravagance of luggage containers increase, an improved design is required. The present invention is designed to provide a luggage system whose aesthetic nature and durability are effectively protected without inconveniencing the user.

SUMMARY OF THE INVENTION

The present invention is directed to a to an expandable luggage cover for protecting an expandable luggage container.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention is embodied in a luggage cover for covering a luggage container, comprising a plurality of panels comprising a front panel, a rear panel, a top panel, a bottom panel, a first side panel, and a second side panel, the panels capable of being shaped into a protective shell for covering the luggage container, and a first fastening apparatus for detachably fastening the plurality of panels together to maintain the shape of the protective shell, wherein one of the plurality of panels is an expandable panel.

In one aspect of the invention, the front panel is the expandable panel. The expandable panel allows the luggage cover to cover an expanded luggage container by being expanded by unfastening a second fastening apparatus formed along the perimeter of the expandable panel. The expandable panel is kept in an unexpanded state by keeping the second fastening apparatus in a closed state, wherein the second fastening apparatus may be a zipper mechanism, a snap-button fastener or a hook-and-loop fastener.

In another aspect of the invention, the plurality of panels of the luggage cover are made of a weatherproof material.

In a further aspect of the invention, a rear edge of the top panel is connected to a top edge of the rear panel, a rear edge of the first side panel is connected to a first side edge of the rear panel, a rear edge of the second side panel is connected to a second side edge of the rear panel, a rear edge of the bottom panel is connected to a bottom edge of the rear panel, a first side edge of the bottom panel is connected to a bottom edge of the first side panel, a second side edge of the bottom panel is connected to a bottom edge of the second side panel, and a top edge of the front panel is connected to a front edge of the top panel, wherein the plurality of panels are connected together by stitching or may comprise a continuous sheet of material.

In a detailed aspect of the invention, the first fastening apparatus comprises a first fastening device for detachably coupling with a second fastening device, the first fastening device being formed on a top and front edge of the first side panel, a front edge of the bottom panel and a top and front edge of the second side panel, the second fastening device being formed on a first and second side edge of the top panel and a first and second side edge and a bottom edge of the front panel, wherein the first fastening device comprises a first zipper track, the second fastening device comprises a second zipper track, the first fastening apparatus further comprises a zipper slider for detachably coupling the first fastening device and the second fastening device.

In yet another aspect of the invention, the bottom panel comprises at least one aperture for exposing an external component of the luggage container, the top panel comprises at least one aperture for exposing an external component of the luggage container, and the first side panel comprises at least one aperture for exposing an external component of the luggage container.

In yet a further aspect of the invention, the plurality of panels are made of a flexible material, wherein the flexible material allows the luggage cover to be folded and stored into a pocket of the luggage container.

In a more detailed aspect, the first fastening device comprises a plurality of first snap-buttons, the second fastening device comprises a plurality of second snap-buttons, and the first snap-buttons are capable of engaging the second snap-buttons for detachably coupling the first fastening device and the second fastening device.

In yet another detailed aspect, the first fastening device comprises a plurality of hooks, the second fastening device comprises a plurality of loops, the hooks capable of engaging the loops for detachably coupling the first fastening device and the second fastening device.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. Features, elements, and aspects of the invention that are referenced by the same numerals in different figures represent the same, equivalent, or similar features, elements, or aspects in accordance with one or more embodiments.

FIG. 6 is a perspective view of a luggage cover capable of being stored in a pocket of a luggage container in accordance with an embodiment of the present invention.

FIG. 7 is a perspective view of a luggage cover covering a bottom surface of a luggage container in accordance with an embodiment of the present invention.

DETAILED DESCRIPTION OF THE PREFERRED EMBODIMENTS

The present invention relates to an expandable luggage cover for protecting an expandable luggage container.

Figure 1:
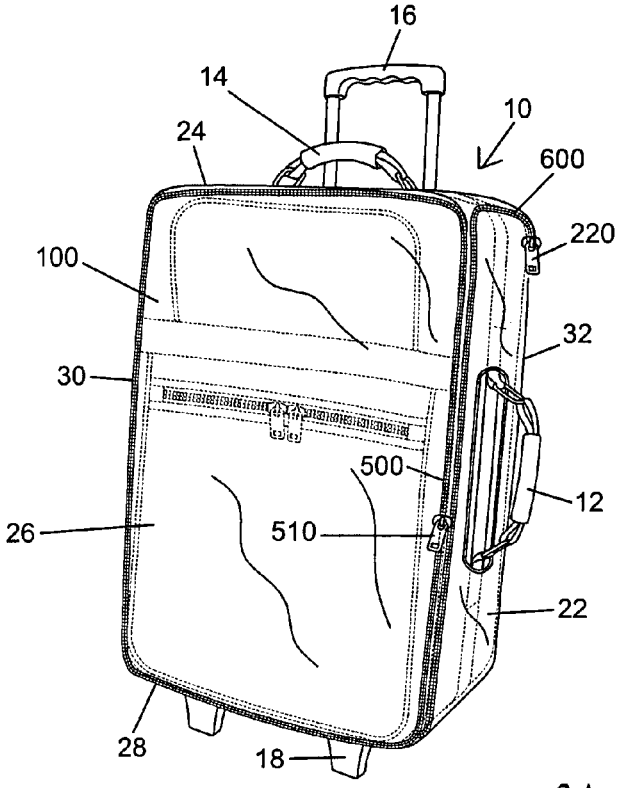
FIG. 1 is a perspective view of a luggage cover protecting a luggage container in an upright position in accordance with an embodiment of the present invention.
Figure 3A:
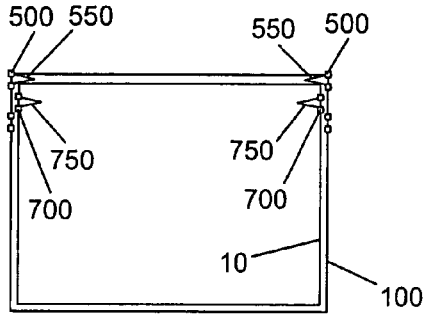
FIG. 3A is a cross-sectional view of an unexpanded luggage cover protecting an unexpanded luggage container in accordance with an embodiment of the present invention.
Figure 2A:
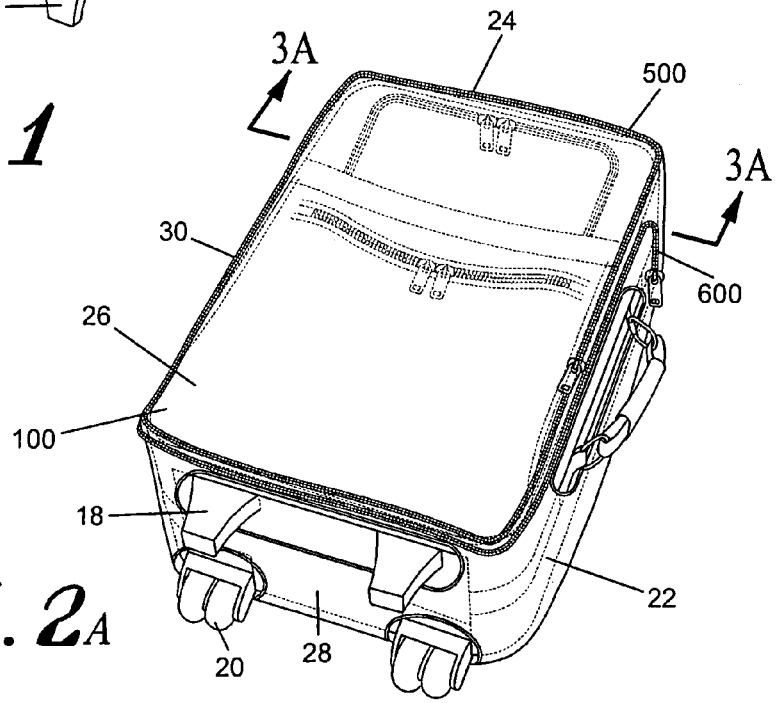
FIG. 2A is a perspective view of an unexpanded luggage cover protecting an unexpanded luggage container in a lying position in accordance with an embodiment of the present invention.

Referring to FIGS. 1 and 2A, an embodiment of the present invention comprises an expandable luggage cover 100 capable of acting as a protective shell for an expandable luggage container 10. The luggage container 10 may include a non-extendable handle 12 centrally mounted at a side surface 22 of the luggage container and a non-extendable handle 14 centrally mounted at a top surface 24 of the luggage container. The luggage container 10 may further include an extendable handle 16 extending substantially along the length of the of the luggage container 10. The extendable handle may be mounted at a position that is adjacent to the back surface 32 of the luggage container. When in use, the extendable handle 16 may be extended out of the top surface 24 to a predetermined distance and used by a user to pull the luggage container 10 by rolling wheels 20 after first tilting the luggage container. Also included with the luggage container 10 is an expandable compartment for adjusting the size of the container. Accordingly, when a user requires more room in the container to accommodate more luggage, the expandable compartment may be expanded to increase the interior volume of the container. Preferably, the expandable compartment of the container 10 may be kept unexpanded by a container fastener 700, as shown in FIG. 3A.

Figure 5:
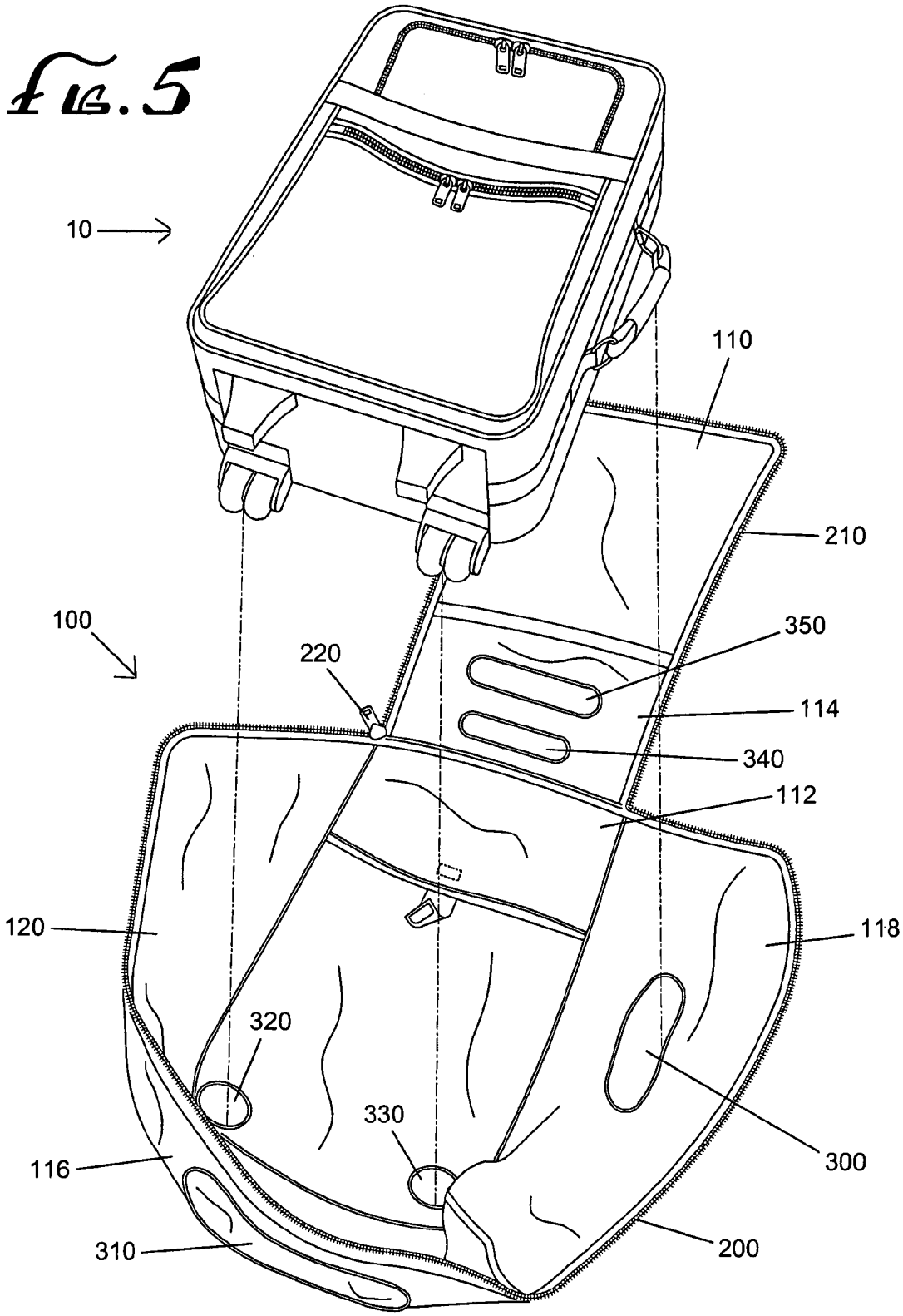
FIG. 5 is a perspective view of an unprotected luggage container and a luggage cover in an open position in accordance with an embodiment of the present invention.

Referring to FIG. 5, the luggage cover 100 comprises a plurality of panels, the panels capable of being shaped into a protective shell for protecting the luggage container 10. Preferably, the panels are made of any weatherproof material such as nylon or vinyl. As shown, the plurality of panels may be depicted by a front panel 110, a rear panel 112, a top panel 114, a bottom panel 116, a first side panel 118 and a second side panel 120. Such panels coincide with a front surface 26, a rear surface 32, a top surface 24, a bottom surface 28, a first side surface 22 and a second side surface 30 of the luggage container 10, respectively, as shown in FIGS. 1 and 2A. In a preferred embodiment, a rear edge of the top panel 114, a rear edge of the first side panel 118, a rear edge of the second side panel 120 and a rear edge of the bottom panel 116 are all connected to respective edges of the rear panel 112. Moreover, a first side edge and a second side edge of the bottom panel 116 are connected to a bottom edge of the first side panel 118 and a bottom edge of the second side panel 120, respectively. Preferably, the panels are stitched together; however, they may also be continuously connected by the use of a single sheet of material or coupled together by any suitable fastener known to one of ordinary skill in the art such as snaps, hook and loop fasteners or the like. Such a design allows the luggage cover 100 to tailor to the form of the luggage container 10 as the luggage cover 100 is draped over the luggage container 10 when in use.

Notably, the front panel 110 is not directly connected to the rear panel 112; rather, the front panel is connected to a front edge of the top panel 114. When the luggage cover 100 is in an open position, as shown in FIG. 5, the luggage container 10 may be placed therein. Once the container is placed, the luggage cover may be manipulated to fittingly form with the luggage container. This is done by lining up the rear panel 112 with the rear surface 32, the first side panel 118 with the first side surface 22, the second side panel 120 with the second side surface 30, the bottom panel 116 with the bottom surface 28 and the top panel 114 with the top surface 24. As stated above, the front panel 110 is coupled to the front edge of the top panel 114. Thus, as the top panel 114 is aligned with the top surface of the luggage contiainer, the front panel folds over and aligns with the front surface 26.

Figure 4A:
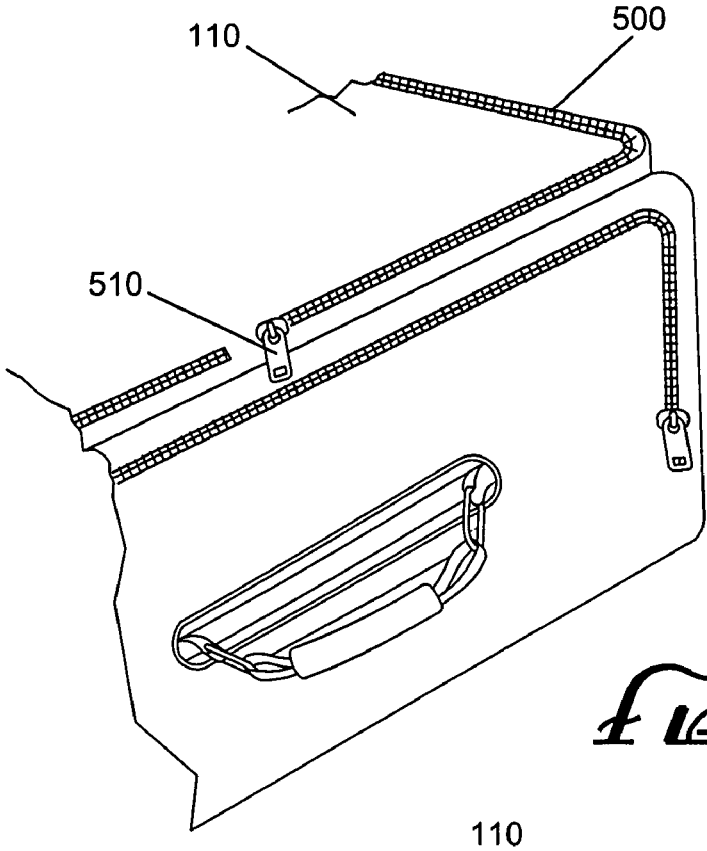
FIG. 4A is a perspective view of an unexpanded luggage cover in accordance with an embodiment of the present invention.

In one embodiment, the front panel 110 is an expandable panel for fittingly accommodating an expandable luggage container 10. As shown in FIGS. 2A and 4A, the expandable panel 110 may be kept in an unexpanded state when a second fastening apparatus 500, formed along the perimeter of the front panel 110, is kept in a closed state. The second fastening apparatus 500 preferably comprises a zipper mechanism for coupling together two zipper tracks with zipper slider 510; however, any suitable fastener such as snaps, hook and loop fasteners or the like may be utilized to keep the expandable panel 110 in an unexpanded state. As shown in FIG. 3A, when the luggage container 10 and the luggage cover 100 are both in an unexpanded state, the container fastener 700 keeps expandable material 750 of the luggage container 10 folded within. Likewise, the second fastening apparatus 500 keeps expandable material 550 of the luggage cover 100 folded within.

Figure 2B:
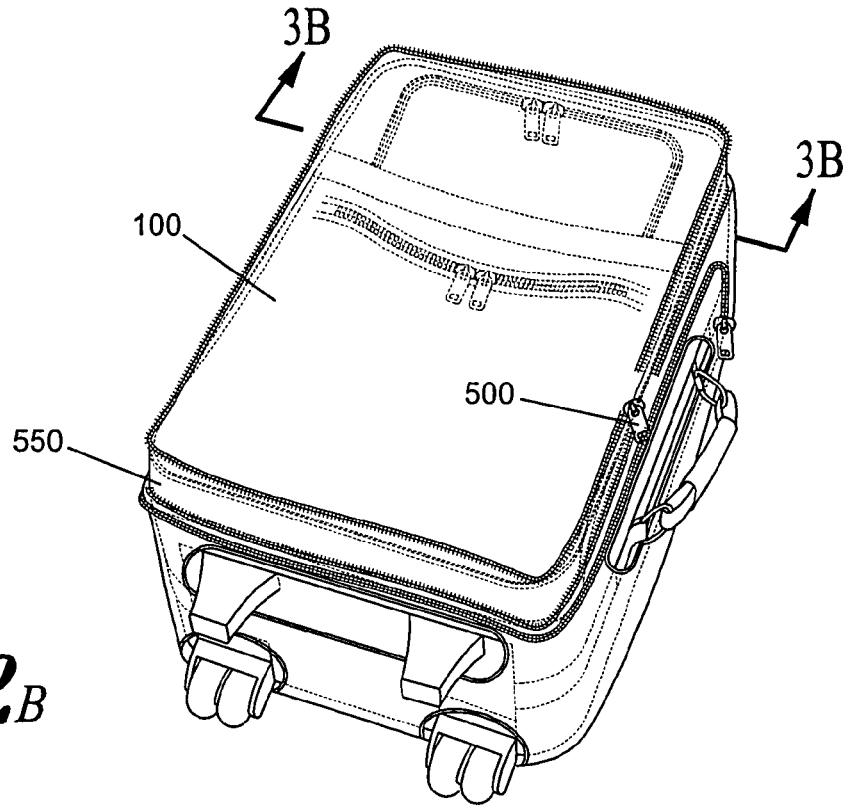
FIG. 2B is a perspective view of an expanded luggage cover protecting an expanded luggage container in a lying position in accordance with an embodiment of the present invention.
Figure 3B:
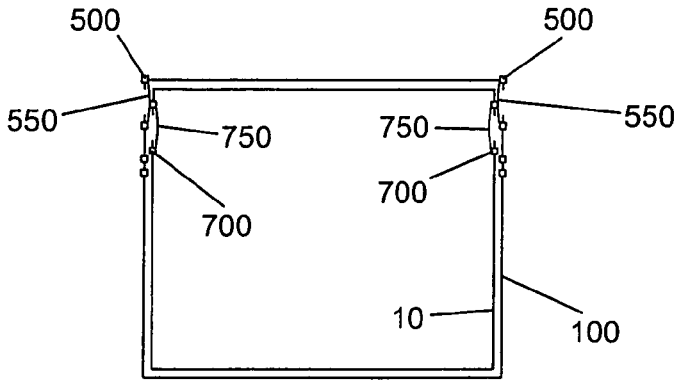
FIG. 3B is a cross-sectional view of an expanded luggage cover protecting an expanded luggage container in accordance with an embodiment of the present invention.
Figure 4B:
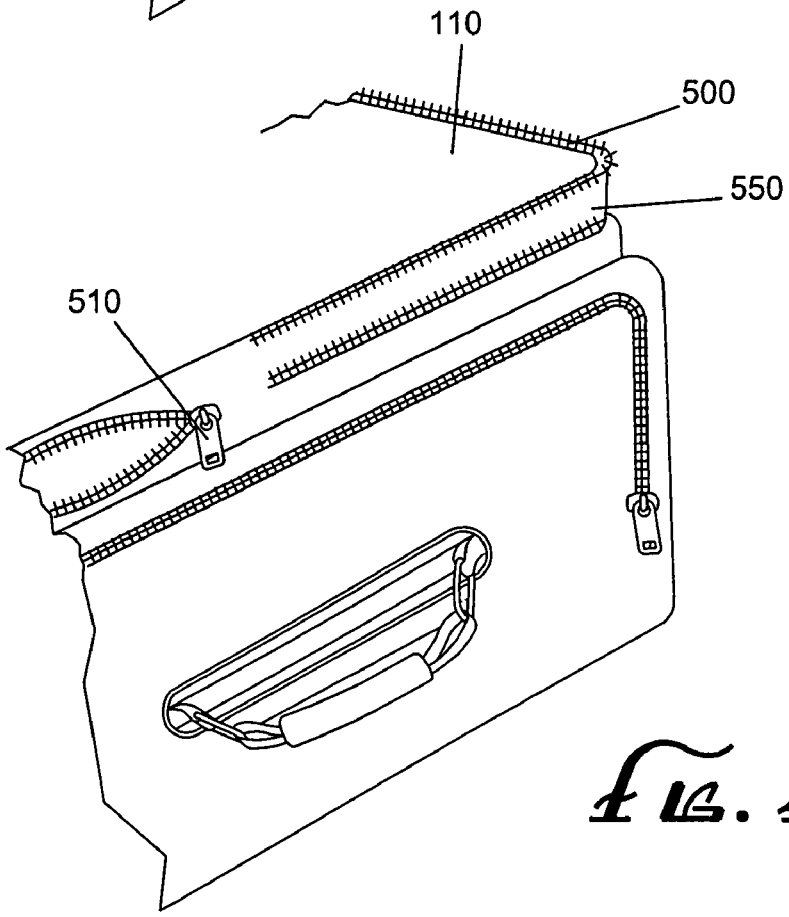
FIG. 4B is a perspective view of an expanded luggage cover in accordance with an embodiment of the present invention.

When additional room is needed in the luggage container 10, a user may expand the expandable compartment of the luggage container 10. Accordingly, the luggage cover 100 may also be expanded to fit over the expanded container. In order to expand the luggage cover, a user unfastens the second fastening apparatus 500 to expand the expandable material 550 of the luggage cover 100, as shown in FIGS. 2B and 4B. As depicted in FIG. 3B, when the luggage container 10 and the luggage cover 100 are both in an expanded state, the unfastened container fastener 700 allows the expandable material 750 of the luggage container 10 to unfold. Similarly, the unfastened second fastening apparatus 500 allows the expandable material 550 of the luggage cover 100 to unfold. Consequently, the expandable material 550 stretches to accommodate the expanded container 10.

In order to seal the luggage cover 100 around the luggage container 10, a first fastening apparatus 600 is employed, as shown in FIGS. 1, 2A and 5. The first fastening apparatus 600 comprises a first fastening device 200 formed on a top and front edge of the first side panel 118, a front edge of the bottom panel 116, and a top and front edge of the second side panel 120. The first fastening device 200 is designed to detachably couple with a second fastening device 210 formed on a first and second side edge of the top panel 114 and a first and second side edge and a bottom edge of the front panel 110. Although the panels may be sealed together using any suitable fastener such as snaps, hook and loop fasteners or the like, it is preferable that the first fastening device 200 and the second fastening device 210 comprise zipper tracks capable of coupling to one another. As such, the fastening apparatus 600 further comprises zipper slider 220 to zip together the first fastening device 200 and the second fastening device 210. When zipped, the edges of the panels formed with the fastening devices couple together to form a protective shell around the luggage container 10. Accordingly, the luggage cover 100 strongly seals the luggage container 10 within due to the robust nature of the zipper device.

As shown in FIGS. 2A and 5, the luggage cover 100 comprises apertures for exposing external features of the luggage container 10 when the cover encloses the container. Preferably, the side panel 118 includes an aperture 300 for exposing the non extendable handle 12. Further, the bottom panel panel 116 may include aperture 310 for exposing legs 18 as well as apertures 320 and 330 for exposing the wheels 20. The top panel 114 may include aperture 340 and aperture 350 for exposing the extendable handle 16 and the non-extendable handle 14, respectively. Thus, while the luggage container 10 is protected by the luggage cover 100, the extendable handle 16 may still be extended out of the top surface 24 to a predetermined distance and used by a user to pull the luggage container 10 by rolling exposed wheels 20 after first tilting the luggage container. The covered luggage container may further be left to stand by itself because the legs 18 are left exposed via the aperture 310. In case the user wishes to carry the covered luggage container instead of rolling it, the user may utilize the non-extendable handle 12 accessible through the aperture 300. Likewise, if the user wishes to carry the luggage container 10 in the upright position, the user may utilize the non-extendable handle 14 exposed out of the aperture 350.

Preferably, the luggage cover 100 is made of a flexible material capable of being folded or reduced in size while maintaining its structural integrity. Such a design allows the luggage cover 100 to be stored in a small volume of space when not in use. As shown in FIG. 6, the luggage cover 100 may be rolled or folded into a smaller volume such that it can be kept in an exterior pocket 400 or some other pocket of the luggage container 10. Therefore, when not in use, the luggage cover can be conveniently stored in the luggage container 10 without sacrificing luggage space within a main compartment of the container. When use of the cover is desired, the user merely removes the cover 100 from the container 10, unfolds the cover and places it around the container.

In another embodiment of the present invention, the luggage cover 100 need not include apertures for exposing external components of the luggage container 10. Thus, as shown in FIG. 7, the legs 18 and the wheels 20 may be entirely covered by the luggage cover 100. It is also noted that while the extendable handle 12 is shown to be exposed in FIG. 7, it is contemplated that the extendable handle 12 may also be completely covered by the luggage cover 100 as well as other external components of the luggage container 10 such as the extendable handle 16 and the non-extendable handle 14 formed atop the luggage container.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structure described herein as performing the recited function and not only structural equivalents but also equivalent structures.

What is claimed is:

1. A luggage cover for covering a luggage container, comprising:

a plurality of panels comprising a front panel, a rear panel, a top panel, a bottom panel, a first side panel, and a second side panel, the panels capable of being shaped into a protective shell for covering the luggage container; and a first fastening apparatus for detachably fastening the plurality of panels together to maintain the shape of the protective shell;

wherein one of the plurality of panels is an expandable panel expanded by unfastening a second fastening apparatus formed along the perimeter of the expandable panel.

2. The luggage cover of claim 1, wherein the front panel is the expandable panel.

3. The luggage cover of claim 1, wherein the expandable panel allows the luggage cover to cover an expanded luggage container.

4. The luggage cover of claim 1, wherein the expandable panel is kept in an unexpanded state by keeping the second fastening apparatus in a closed state.

5. The luggage cover of claim 1, wherein the second fastening apparatus is a zipper mechanism.

6. The luggage cover of claim 1, wherein the panels are made of a weatherproof material.

7. The luggage cover of claim 1, wherein:

a rear edge of the top panel is connected to a top edge of the rear panel;

a rear edge of the first side panel is connected to a first side edge of the rear panel;

a rear edge of the second side panel is connected to a second side edge of the rear panel;

a rear edge of the bottom panel is connected to a bottom edge of the rear panel;

a first side edge of the bottom panel is connected to a bottom edge of the first side panel;

a second side edge of the bottom panel is connected to a bottom edge of the second side panel; and a top edge of the front panel is connected to a front edge of the top panel.

8. The luggage cover of claim 7, wherein the panels are connected together by stitching.

9. The luggage cover of claim 7, wherein the panels comprise a continuous sheet of material.

10. The luggage cover of claim 1, wherein:

the first fastening apparatus comprises a first fastening device for detachably coupling with a second fastening device;

the first fastening device being formed on a top and front edge of the first side panel, a front edge of the bottom panel and a top and front edge of the second side panel;

the second fastening device being formed on a first and second side edge of the top panel and a first and second side edge and a bottom edge of the front panel.

11. The luggage cover of claim 10, wherein:

the first fastening device comprises a first zipper track;

the second fastening device comprises a second zipper track; and the first fastening apparatus further comprises a zipper slider for detachably coupling the first fastening device and the second fastening device.

12. The luggage cover of claim 1, wherein the bottom panel comprises at least one aperture for exposing an external component of the luggage container.

13. The luggage cover of claim 1, wherein the top panel comprises at least one aperture for exposing an external component of the luggage container.

14. The luggage cover of claim 1, wherein the first side panel comprises at least one aperture for exposing an external component of the luggage container.

15. The luggage cover of claim 1, wherein the panels are made of a flexible material.

16. The luggage cover of claim 15, wherein the flexible material allows the luggage cover to be folded and stored into a pocket of the luggage container.

* * * * *